US006267446B1

(12) United States Patent
Wieland et al.

(10) Patent No.: US 6,267,446 B1
(45) Date of Patent: Jul. 31, 2001

(54) COMPRESSED UPHOLSTERED FURNITURE ASSEMBLY KIT AND METHOD OF MANUFACTURE

(75) Inventors: Roy M. Wieland, Fort Wayne; Blaine L. Wieland, Spencerville, both of IN (US)

(73) Assignee: Home Reserve, Inc., Grabill, IN (US)

( * ) Notice: Subject to any disclaimer, the term of this patent is extended or adjusted under 35 U.S.C. 154(b) by 39 days.

(21) Appl. No.: 08/855,921

(22) Filed: May 14, 1997

(51) Int. Cl.[7] ..... A47C 7/00

(52) U.S. Cl. ..... 297/440.13; 297/440.1; 297/440.11; 297/188.08; 297/188.11; 297/440.14; 297/284.6; 53/436

(58) Field of Search ..... 297/440.13, 440.11, 297/219.1, 221, 230.1, 230.11, 146, 188.08, 440.1, 440.14; 53/433, 434, 436; 206/417, 524.8

(56) References Cited

U.S. PATENT DOCUMENTS

| | | | | |
|---|---|---|---|---|
| 126,009 | * | 4/1872 | Beidler | 297/146 |
| 2,279,864 | * | 4/1942 | Eide | 297/440.14 X |
| 2,334,912 | * | 11/1943 | Eide | 297/440.13 X |
| 2,364,012 | * | 11/1944 | Walton et al. | 206/524.8 X |
| 2,418,731 | * | 4/1947 | Seitz | 297/440.13 X |
| 2,532,863 | * | 12/1950 | Taylor | 297/440.13 X |
| 2,545,243 | * | 3/1951 | Rumsey et al. | 206/524.8 X |
| 2,660,228 | * | 11/1953 | Reinhold | 297/440.1 |
| 2,692,007 | * | 10/1954 | Christian | 297/188.08 |
| 2,738,834 | * | 3/1956 | Jaffe et al. . | |
| 3,061,165 | * | 10/1962 | Rench et al. | 206/524.8 |
| 3,083,889 | * | 4/1963 | Christensson | 206/524.8 |
| 3,458,966 | * | 8/1969 | Dunbar et al. | 206/417 X |
| 3,467,433 | * | 9/1969 | Lindau et al. | 297/440.13 |
| 3,540,776 | * | 11/1970 | Wilson | 297/284.6 X |
| 3,680,916 | * | 8/1972 | Gilbert et al. | 297/440.11 |
| 3,747,743 | * | 7/1973 | Hoffman, Jr. | 206/417 X |
| 4,055,924 | * | 11/1977 | Beaver, Jr. | 297/440.13 X |
| 4,078,842 | * | 3/1978 | Zur | 297/284.6 X |
| 4,140,065 | * | 2/1979 | Chacon | 297/440.13 X |
| 4,184,608 | * | 1/1980 | Christensson | 206/524.8 X |
| 4,418,514 | * | 12/1983 | Spann | 53/436 |
| 4,521,928 | * | 6/1985 | Stephenson | 5/400 |
| 4,575,886 | * | 3/1986 | Larson | 5/450 |
| 4,577,816 | * | 3/1986 | Foster | 206/524.8 X |
| 4,593,950 | * | 6/1986 | Infanti | 297/440.13 |
| 4,675,929 | * | 6/1987 | Santo | 5/400 |
| 4,679,260 | * | 7/1987 | Frettom | 5/82 R |
| 4,697,847 | * | 10/1987 | Heischlag | 297/440.11 X |
| 4,788,727 | * | 12/1988 | Liu | 5/174 |

(List continued on next page.)

*Primary Examiner*—Peter M. Cuomo
*Assistant Examiner*—Rodney B. White
(74) *Attorney, Agent, or Firm*—Baker & Daniels

(57) ABSTRACT

A compressed upholstered furniture assembly kit, method of manufacture and assembled article of furniture. A consumer-assembled article of furniture having upholstered portions is provided in a manner which comports with the shipping, warehousing and display constraints of retailers and which accommodates a variety of consumer decorating tastes. The kit includes frame members and reduced volume padding. This padding, when exposed to air at atmospheric pressure expands to its natural size and shape. The padding may include a porous protective cover which is applied prior to reducing its volume, and may also include a bladder to which fluid is added to provide further expansion. The expanded padding provides cushions which are covered with separately available decorative, fitted covers to form upholstered pieces, which are then applied to the assembled frame to form a completed article of furniture. Alternatively, the cushions may be applied to the assembled frame prior to being covered by the decorative fabric covers. The separately available fabric covers are of various decorative patterns and colors and can be used interchangeably with the assembled frame and its cushions.

20 Claims, 6 Drawing Sheets

U.S. PATENT DOCUMENTS 4,828,324 * 5/1989 Patnam ..... 297/440.1
4,841,586 * 6/1989 Juster et al. ..... 5/181
4,879,775 * 11/1989 Keefer ..... 5/400
4,881,779 * 11/1989 Bubien ..... 297/440.13
4,883,317 * 11/1989 Davenport ..... 297/188.11 X
4,925,245 * 5/1990 Pendelton et al. ..... 297/188.11 X
4,928,337 * 5/1990 Chauncey ..... 5/465
5,115,526 * 5/1992 Boyd ..... 5/451
5,415,461 * 5/1995 Sakamoto ..... 297/440.1
5,564,141 * 10/1996 Anderson ..... 5/668
5,622,030 * 4/1997 Steed et al. ..... 53/436
5,671,492 * 9/1997 Simon ..... 5/722
5,689,844 * 11/1997 Liu ..... 5/636
6,000,079 * 12/1999 Dranger ..... 5/706

* cited by examiner

COMPRESSED UPHOLSTERED FURNITURE ASSEMBLY KIT AND METHOD OF MANUFACTURE

BACKGROUND OF THE INVENTION

1. Field of Invention

The invention relates generally to furniture and the packaging of furniture for shipment and storage. More particularly, the invention relates to ready-to-assemble furniture, which is to be assembled by the purchaser or end user from packaged components, and the packaging of ready-to-assemble furniture.

2. Background Art

Ready-to-assemble furniture is furniture which is packaged for shipment and storage in disassembled form, with assembly to be done by the consumer or end user. Examples of existing ready-to-assemble furniture include bookcases, television stands, and simple chairs and benches. Furthermore, mass merchandised ready-to-assemble furniture is expected to be rather less expensive to the consumer than comparable pre-assembled furniture or to have distinctive functional features generally not available with its pre-assembled counterpart.

Because of limited shelf or warehousing space in retail facilities, ready-to-assemble furniture available at retail is generally limited to furniture which can be compactly contained in a lightweight, easy to handle package which can be conveniently displayed and transported. Consequently, the genre of ready-to-assemble furniture packaged for mass merchandising retail sale has generally comprised pieces of furniture which are utilitarian or hard-surfaced, and which are available in only limited colors or surface finishes. As such, prior ready-to-assemble furniture does not satisfy the need for primary pieces of upholstered living room furniture in a typical household.

A method is needed to provide comfortable, inexpensive furniture of high quality in a compact, easily storable and transportable way, for distribution by mass merchandising channels and which can accommodate a wide variety of consumer decorating tastes.

SUMMARY OF THE INVENTION

The present invention uses reduced volume padding in a method of making a kit which provides high quality, ready-to-assemble upholstered furniture. The kit includes a lightweight, compact, easy to handle package well-suited to the shipping, storage and display needs of the mass merchandising industry. The kit, when assembled, provides an article of comfortable upholstered furniture which can match a variety of decors. Interchangeable, fitted decorative coverings are separately provided to cover the furniture and provide continued flexibility and variety in accommodating the consumer's decorating tastes.

The lightweight, compact and maneuverable package is advantageous because it can be efficiently stocked on the display or inventory shelves of mass merchandising retailers.

Accommodating various consumer decorating tastes by having a variety of interchangeable, fitted covering fabrics for the furniture is another advantage associated with the present invention. The covers can be sold separately alongside the package containing the article of furniture.

The ease of transportation of the compact kits by merchants reduces shipping costs and/or labor. Further, the compact nature of the kits allows consumers to easily take the furniture home at the time of sale in their own vehicles, rather than requiring them to wait for later delivery by the retailer.

Conventional, pre-assembled upholstered furniture can be generally classified as having high quality and high cost, or low quality and low cost. The present invention provides ready-to-assemble upholstered furniture of high quality and low cost.

In one embodiment, the present invention provides a method of packaging disassembled upholstered furniture by disposing individual frame members, reduced volume padding and the requisite fasteners into a kit which can be easily shipped, stored, displayed on retail shelves, and transported by the consumer. This embodiment contemplates a variety of fitted covers separately available alongside the kit containing the disassembled furniture.

In another embodiment, the present invention provides an article of upholstered furniture assembled from the components which are disposed in the above-described kit via the present invention method.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
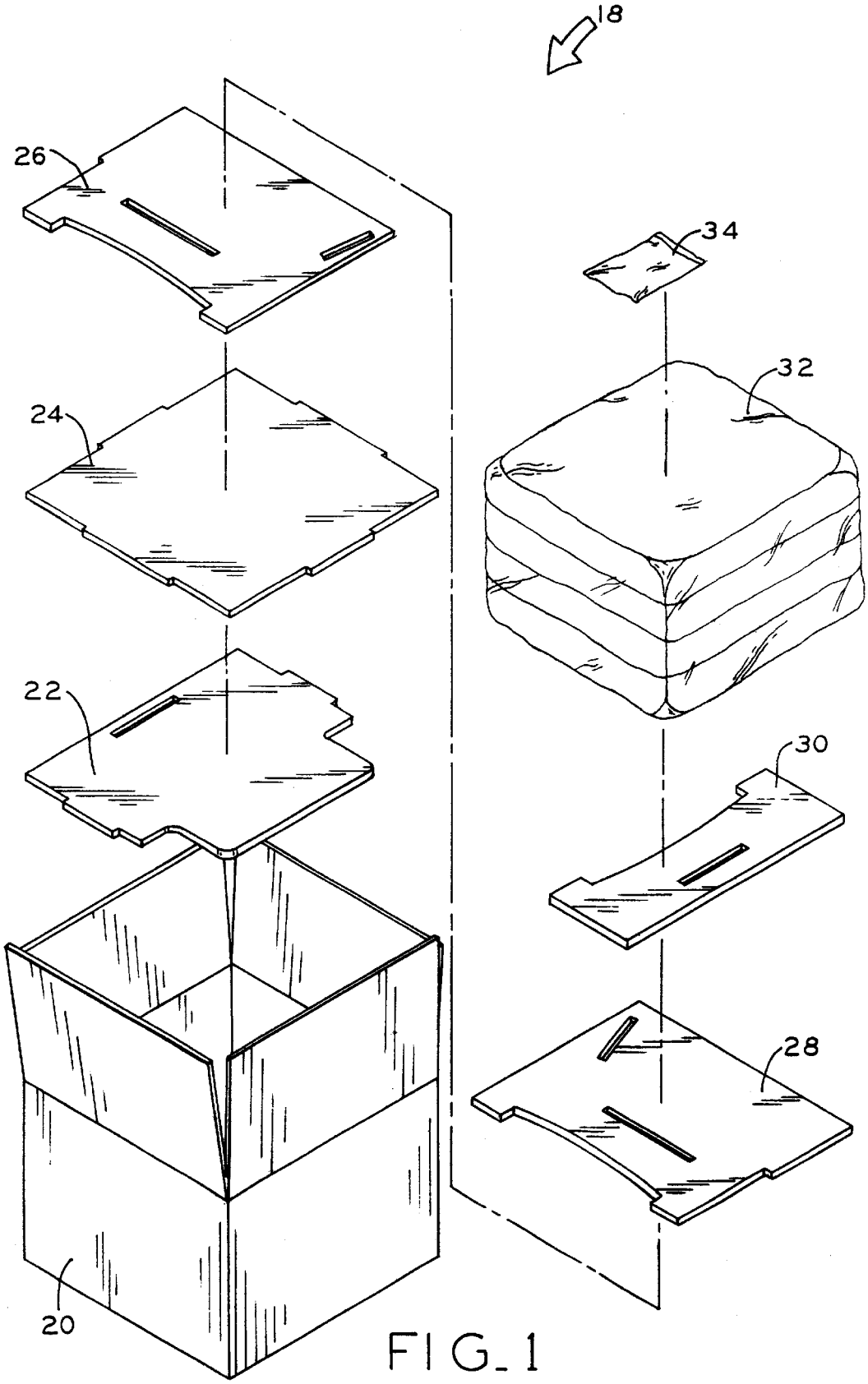
FIG. 1 is an exploded view illustrating the contents of one embodiment of the kit of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its teachings.

Referring now to the drawings and particularly to FIG. 1, kit 18 having all necessary frame members 22–30, padding 32 in the form of vacuum-packed foam cushions and package 34 containing any required fasteners for the frame or assembly instructions is packaged into carton 20 or other suitable container of appropriate size. In one embodiment of the present invention, individual frame members 22–30 are individually wrapped in paper or other suitable material (not shown) to prevent scratches, and are then stacked inside carton 20 in a compact, orderly manner. Reduced volume padding 32 is then placed inside carton 20 such that it substantially occupies the remaining volume of carton 20. Package 34 is envisioned to be rather small and is placed in whatever space then remains inside carton 20. In this manner, a piece of upholstered ready-to-assemble furniture which, when assembled, is comparable in size to a conventional, pre-assembled piece of furniture, may be compactly packaged. Alternatively, the disassembled frame and the reduced volume padding comprising the kit may be packaged in separate cartons in cases of the volume requirements of each being such as to make inefficient the use of a single carton.

The number, size and shape of frame members 22–30 will vary depending on the article of furniture to be produced from the kit of the present invention, but in all embodiments, the frame members are a suitable supporting material, such as prefinished plywood. Alternative frame member embodiments using materials such as solid wooden boards, laminated particle board, preformed plastic or metal pieces, varieties of fiberboard or strandboard, structural cardboard or honeycombed paperboard are within the scope of the invention. Further, it is within the scope of the invention that fasteners may not be required for interconnecting the frame members is within the scope of this invention. For example, frame assembly may instead consist of interconnecting frame members which include slots allowing their mutual engagement, or adhesives may be used to join the frame members. Still further, it is within the scope of the invention that frame members may or may not be pre-finished. For example, the frame members may consist of unfinished wooded pieces that the consumers may stain and varnish or paint to suit their individual tastes.

Individual padding elements appropriate to the article of furniture to be produced from kit 18 of the present invention are reduced in volume, such as by being vacuum-packed or by being compressed between plates, or by a combination of these methods, into compressed form which greatly reduces the volume otherwise necessary to package kit 18. The padding should be reduced by approximately two thirds (⅔) from its original, expanded size to properly practice the present invention, but further reduction is desirable and the amount of volume reduction achievable may vary by padding material. By the above-mentioned volume reduction methods, the volume of urethane foam padding, for example, can be reduced to approximately one sixth (⅙) of its natural, expanded size. Although the padding elements may be made from urethane foam, Dacron or any other suitable, compressible materials may be used. Further, different materials may be used for different cushions. For example, in a given article of furniture the seat cushion(s) may be made of urethane foam, while the back and/or arm cushions may be made of Dacron.

The amount of compression foam padding undergoes affects its ability to subsequently expand to its original size. For example, in experiments in which a 12 inch cubic block of urethane foam material having an indentation load deflection (ILD) rating of 35 (i.e., 35 pounds of force is required to deflect the foam by 25 percent) and a density of 1.5 pounds per cubic foot was compressed into a 12 inch square slab 1.5 inches thick, the material expanded to 96 percent of its original volume after 24 hours. Further expansion beyond that time was negligible. In an otherwise identical experiment using urethane foam having a density of 1.2 pounds per cubic foot, the material expanded to 90 percent of its original volume. Compression to a lesser extent would have resulted in each of these samples expanding more nearly to its original volume. Furthermore, where heavy compression takes place in a high humidity environment, plastic deformation in the shape of the expanded urethane foam cushions may result. Therefore, it should be noted that to ensure the foam expands properly to its final shape and size, its compression should take place in a low humidity environment.

Furthermore, compression of the foam material adversely affects its quality. For example, the 1.5 pound per cubic foot urethane foam block subjected to the above described compression test incurred a 2 pound degradation in its ILD rating, dropping from 35 to 33. The 1.2 pound per cubic foot sample had its ILD drop from 35 to 28 under the same conditions. Thus it can be seen that a denser urethane foam better retains its load bearing capability after compression than its lighter weight counterpart. Compression to a lesser extent would have resulted in each of these samples exhibiting a less pronounced degradation in its ILD rating. This degradation in quality manifests itself primarily through reduced longevity of the padding's resilience, and does not necessarily affect the initial comfort it provides.

For urethane foams of a given ILD rating and chemical composition, a denser foam costs more than a lighter weight foam. From the foregoing it can then be understood that, because the cushions' post-expansion sizes, upon which the proportions of the finished article of furniture are determined, and longevity are dependent on their original densities and the extent to which they are compressed, there are tradeoffs to be made between their cost, quality and package. Also, it must be emphasized that the intended post-expansion size of each cushion and its desired life are factors which must be considered in developing the component padding elements of the present invention.

Figure 2:
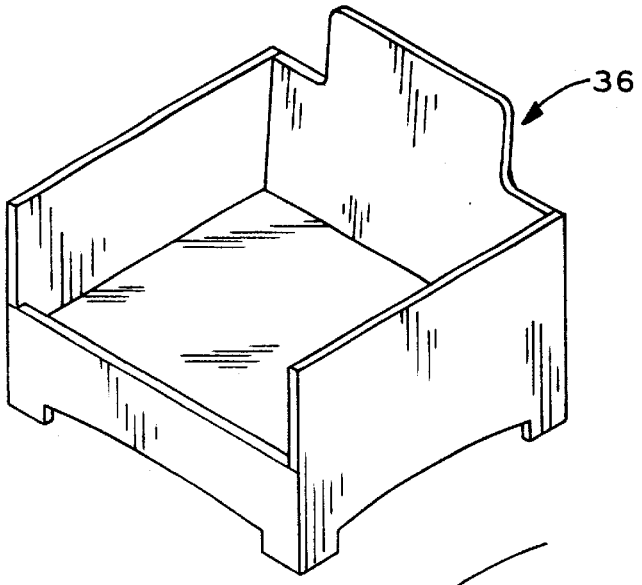
FIG. 2 is a perspective view of the frame of one embodiment produced from the present invention kit.
Figure 3:
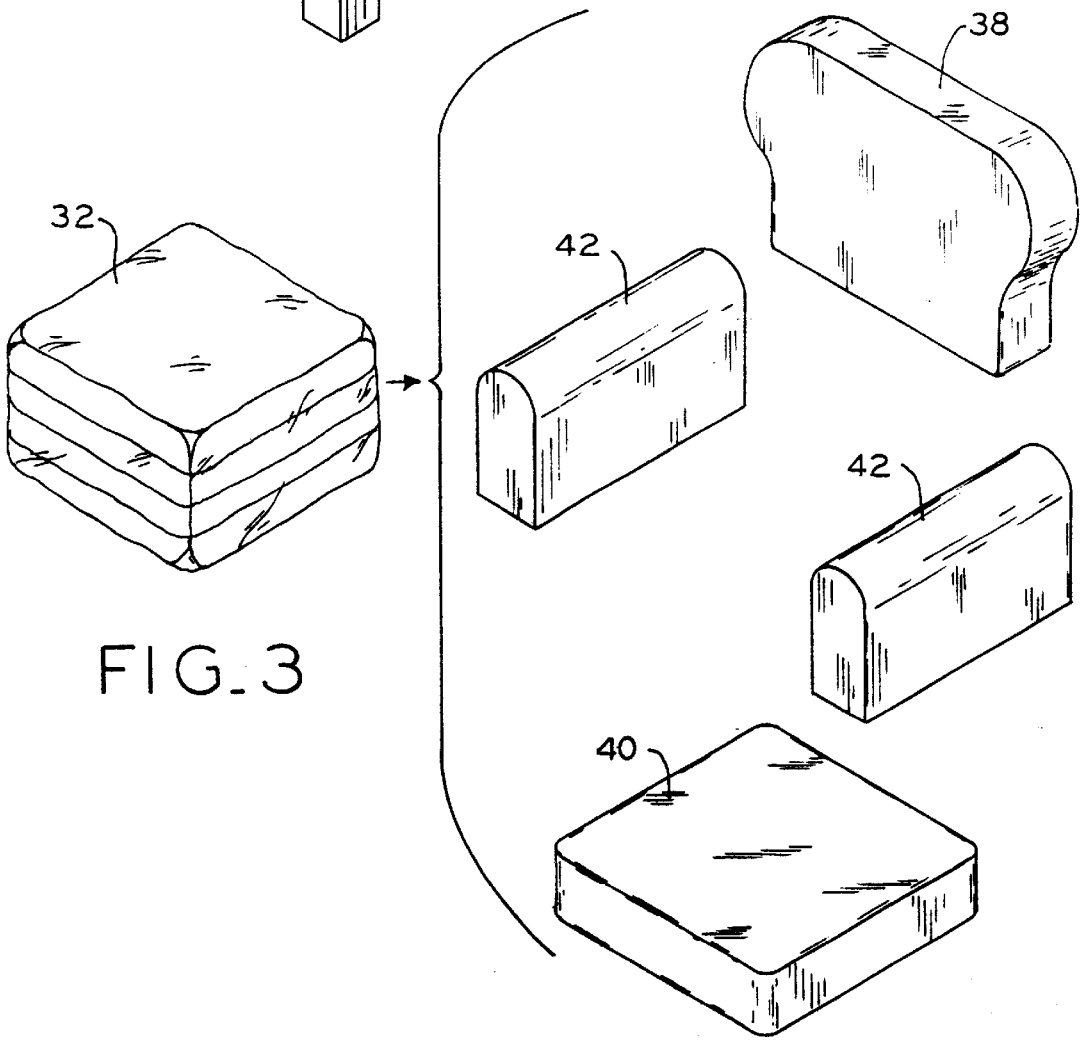
FIG. 3 is a view showing the vacuum-packaged foam pieces of one embodiment of the present invention in their compressed and expanded states.

As the compressed padding elements are unpackaged and allowed to expand, each will take on a size and shape appropriate to upholster frame 36 (FIG. 2). For example, the embodiment of kit 18 contains vacuum-packed foam pieces for padding 32 which, when unpackaged and allowed to expand to their approximate original sizes and shapes, will provide back cushion 38, seat cushion 40 and two arm cushions 42 (FIG. 3).

One embodiment of the present invention contemplates having each cushion covered by a porous, protective cover (not shown) made of a material such as muslin or denim, which may or may not be decorative, prior to the cushion's volume being reduced. Each piece of reduced volume padding in the kit would include such a protective cover. The porosity of the protective cover allows air to exit the cushion during the reduction of the cushion's volume, prior to its being packaged, and to enter the cushion during its expansion, upon unpacking it. The porous protective cover would be fitted to envelop the cushion and be permanently sewn closed or closed thereon with a fastener. Fasteners appropriate for closing the protective cover include, for example, zippers or hook and loop fasteners. As the cushions are expanded during final assembly of the article of furniture, the protective cover would remain on the cushion and may subsequently be covered by the separately provided decorative fabric covers as described below. Further, where foam padding is used, the protective cover will make installation of the decorative fabric covers easier due to the protective cover's surface having a lower coefficient of friction vis-a-vis the surface of the uncovered foam. Installation of the decorative covers will also be made easier where a protective cover is used over padding material having a loose, fibrous composition, such as Dacron. Further still, the protective cover provides the additional advantages of retaining any cushion material debris which accumulates due to normal padding wear or due to fragmentation of loose, fibrous padding material.

Figure 9:
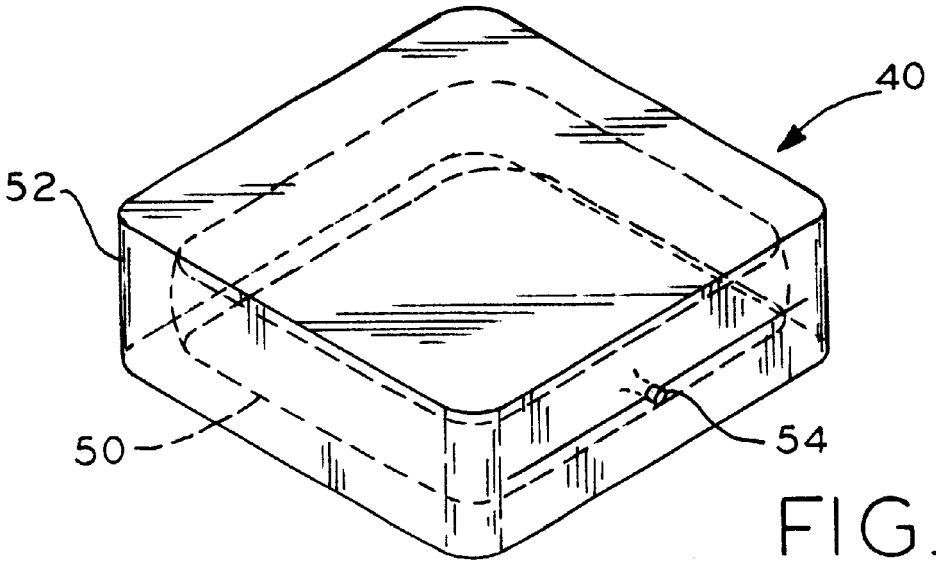
FIG. 9 is a perspective view of one embodiment of a cushion for an article of furniture provided by the present invention.
Figure 10:
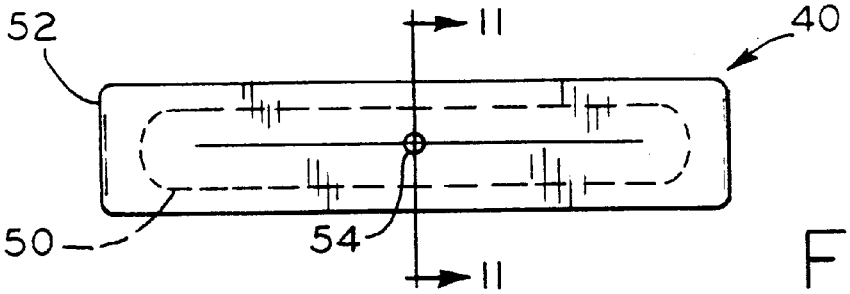
FIG. 10 is a side view of the cushion of FIG. 9.
Figure 11:
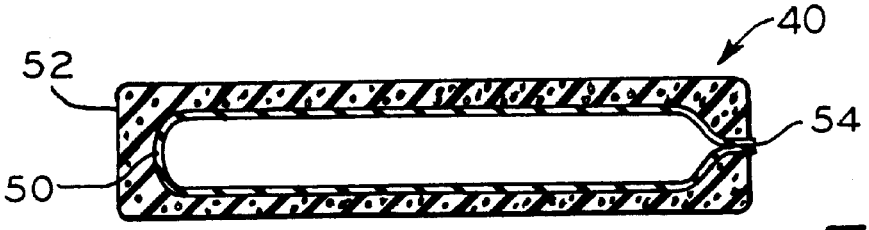
FIG. 11 is a sectional view of the cushion of FIG. 10 along line 11—11.
Figure 12:
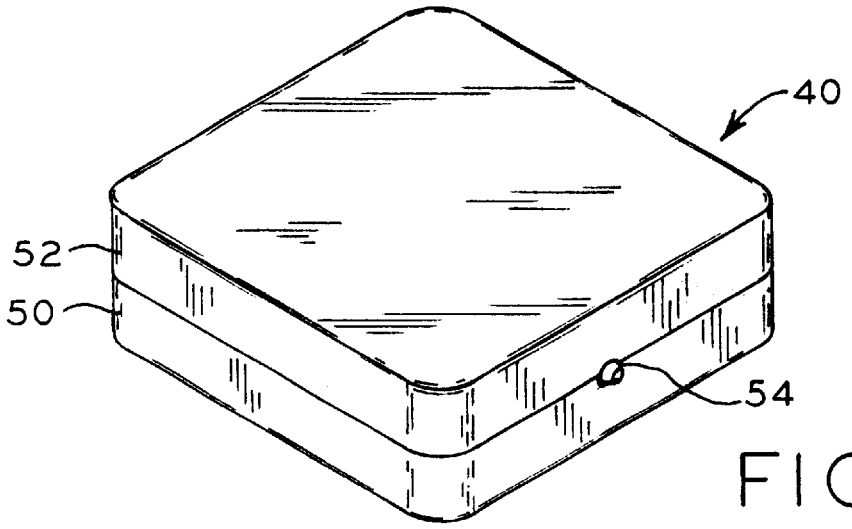
FIG. 12 is a perspective view of a second embodiment of a cushion for an article of furniture provided by the present invention.
Figure 13:
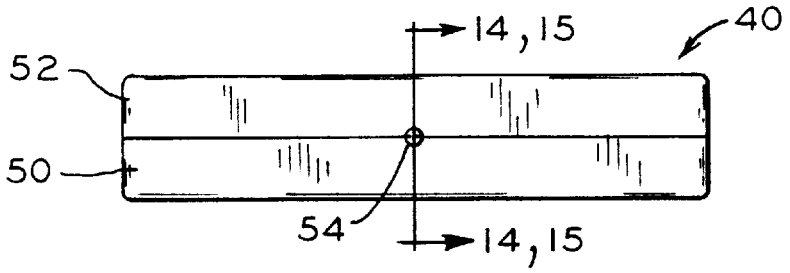
FIG. 13 is a side view of the cushion of FIG. 12.
Figure 14:
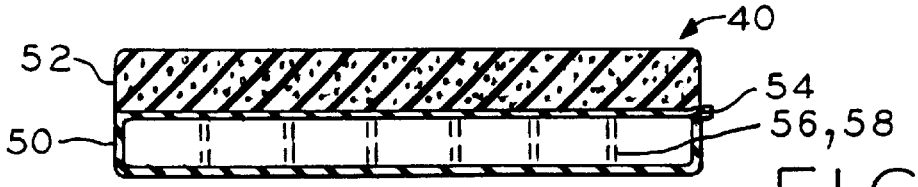
FIG. 14 is a sectional view of the cushion of FIG. 13 along line 14/15—14/15.
Figure 15:
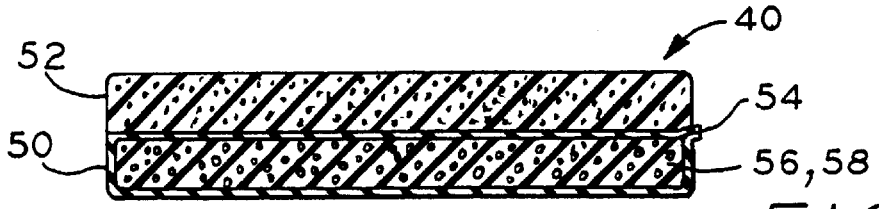
FIG. 15 is an alternative sectional view of the cushion of FIG. 13 along line 14/15—14/15.

Another aspect of the present invention, exemplified in the figures as relating to seat cushion 40 although it is applicable to each cushion, contemplates cushions having flexible bladder 50 (FIGS. 9 and 12) made of a material such as rubber, for example. As shown in FIGS. 9–11, padding material 52 corresponding to seat cushion 40 may envelop the bladder or, as shown in FIGS. 12–15, padding material 52 may be adhered to a only portion of the surface of bladder 50. Bladder 50 is evacuated while the cushion is packaged, and filled with a fluid such as air or water through closeable valve 54 during final assembly of the article of furniture. Bladder 50 may include baffles 56 to dampen the movement of the fluid. Baffles 56 may be of a type which includes staggered or perforated walls 58 attached to the inside surfaces of bladder 50 (FIG. 14) or a of a type which uses a porous filler 60 which is more compressible than the padding material, such as open cell foam, disposed within bladder 50 (FIG. 15). One advantage provided by this embodiment is the further reduction in the package volume required to provide an article of ready-to-assemble upholstered furniture compared to reducing the volume of the padding alone, as described above. Further, adjusting the quantity of fluid in the bladder may accommodate varying comfort levels of the consumers. A cushion having such a bladder may also be used in conjunction with the protective cover described above. During final assembly of the article of furniture, cushions having the fluidfilled bladder may be covered by the separately provided decorative fabric covers as described below.

Accommodating a variety of consumer tastes without requiring excessive warehouse or shelf space is an object of the present invention. Therefore, it will be noted that kit 18 contained in carton 20, which includes frame members 22–30 and reduced volume padding 32, assembles to produce an unupholstered article of furniture. Finished fabric covers to fit each individual padding element, or matching sets thereof to outfit an entire article of furniture, are packaged and made available separately for use with kit 18 contained in carton 20. In this way, a stock of kits can be conveniently warehoused or displayed at retail facilities which, when purchased with one of several different and separately available fabrics, can accommodate a variety of decorating tastes.

Figure 4:
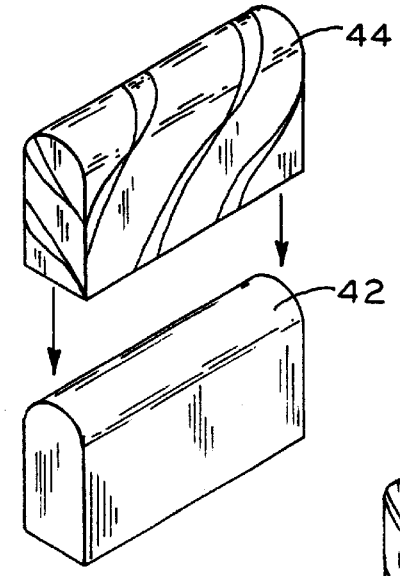
FIG. 4 is a perspective view of the fitted fabric covering for one of the foam pieces of one embodiment of the present invention.

The separately available fabric covers, designed to fit over the expanded padding elements from kit 18, are installed by the consumer. Referring to FIG. 4, a fabric covering 44 is fitted over a foam arm cushion 42 to form an upholstered piece. Similarly, each foam piece is covered by a corresponding fabric cover. Alternatively, a fabric cover may be fashioned to cover more than one padded element. For instance, a single decorative cover may be designed to accommodate the three back cushions for a sofa.

The fabric covers may be secured around the foam pieces by zippers, hook and loop fasteners, adhesives or by merely folding excess material of the fabric under the foam piece itself or into the slotted portion 48 (FIG. 5) of the foam piece, resulting in an upholstered piece 46. The entire padded portion may be covered by fabric, or only the portion that would be visible upon final assembly of the furniture. Notably, the fabrics are interchangeable. The method of making available fabric covering sets separate from kit 18 in a wide variety of patterns and colors allows consumers to easily replace the fabric for repair or redecoration.

Figure 5:
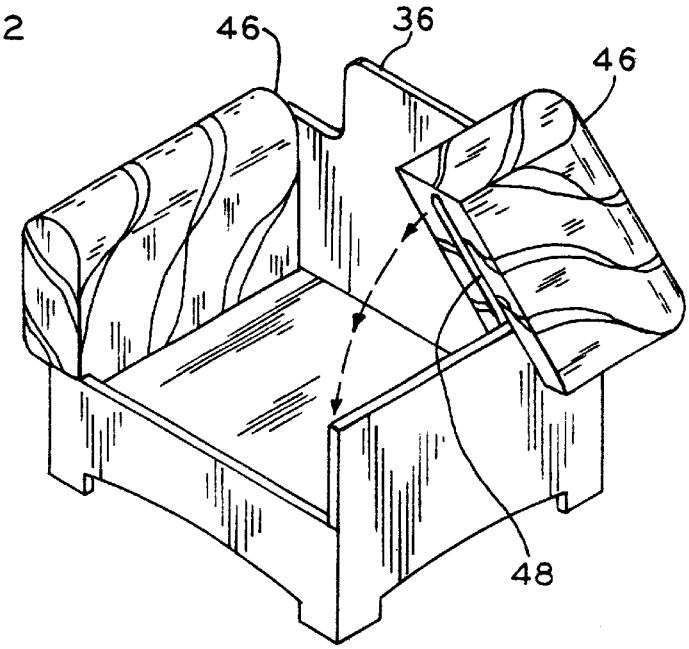
FIG. 5 is a view showing assembly of an upholstered piece to the frame of one embodiment of an article of furniture produced from the present invention kit.

Once the fabric is applied, each upholstered piece is applied to the frame 36. As shown in FIG. 5, some upholstered pieces 46 are fitted over portions of frame 36 shaped to be slidedly received within their slotted portions 48. Other upholstered pieces, such as the seat portion, may be applied to the frame without such engagement. Alternatively, the padded elements are assembled to the frame without fabric covers. In this embodiment, the covers are later installed and are appropriately designed to cover a portion of the frame as well as the cushion. Tape with adhesive on both sides may be used in this embodiment. One side of the tape may be permanently adhered to the frame with the decorative cover, which has been drawn over a cushion, detachably adhered to the other side of the tape. Furthermore, other embodiments may use fabric covers designed to fit over some portions of the frame in lieu of padding. Further still, fabric covers may be used to cover portions of the frame surface which would otherwise be exposed and hard finished.

Figure 6:
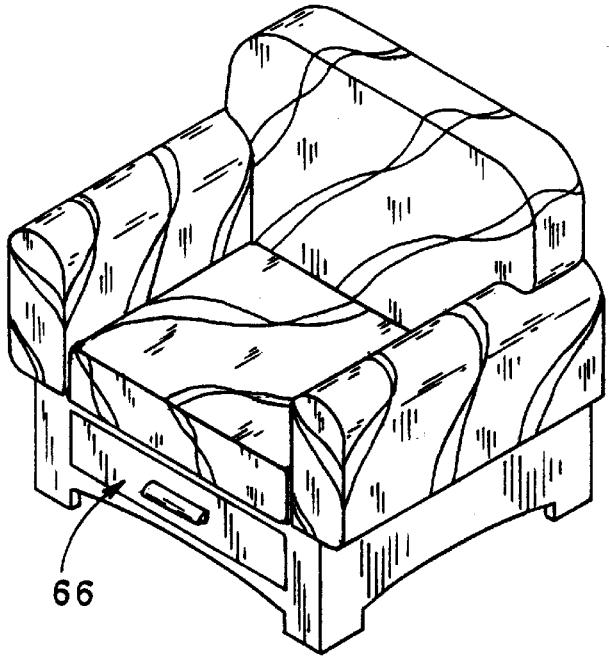
FIG. 6 is a perspective view of a second embodiment of an upholstered article of furniture produced from the present invention kit.
Figure 7:
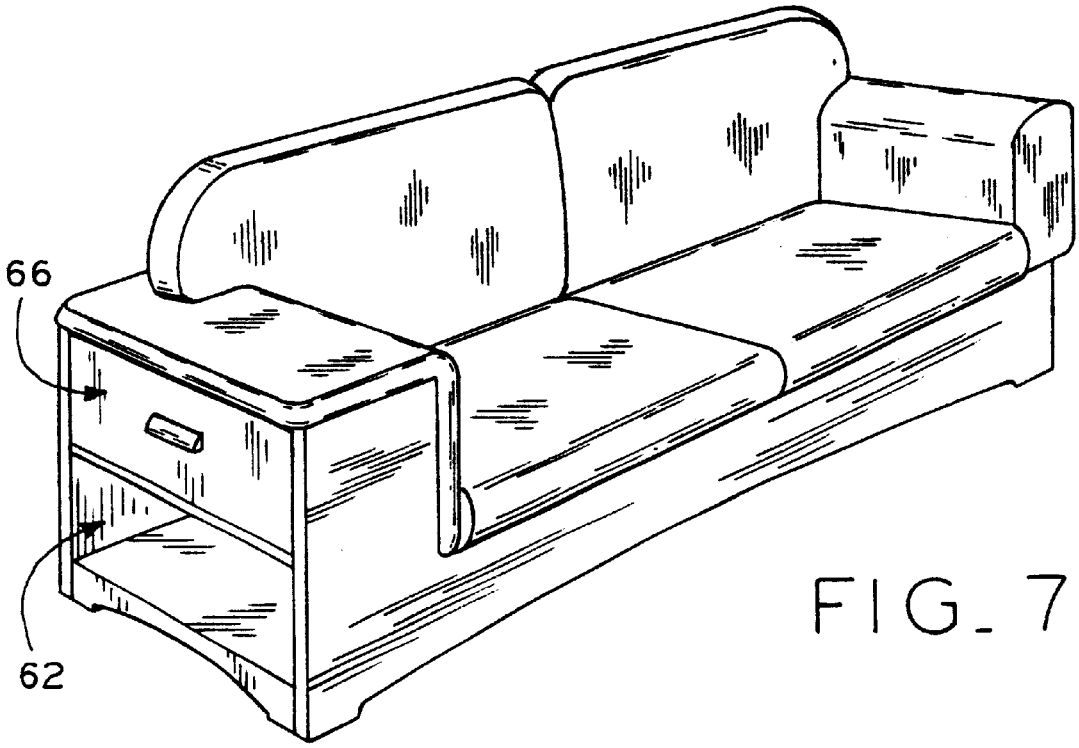
FIG. 7 is a perspective view of a third embodiment of an upholstered article of furniture produced from the present invention kit.
Figure 8:
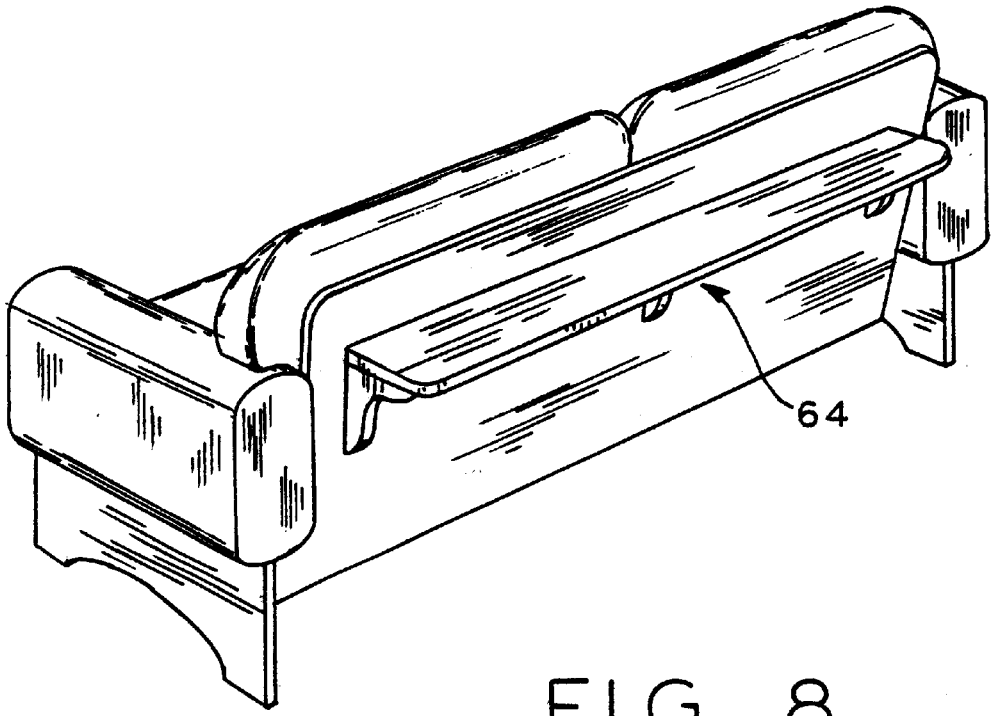
FIG. 8 is a perspective view of a fourth embodiment of an upholstered article of furniture produced from the present invention kit.

As shown in FIGS. 6–8, the article of upholstered furniture from the kit may take the form of, for example, chairs or sofas. Furthermore, the article of furniture may also incorporate features such as drawer 66, as shown in FIGS. 6 and 7, bookcase 62, as shown in FIG. 7, or shelf 64, as shown in FIG. 8. In such embodiments, the components necessary to provide these features are packaged as and/or with frame members into the kit and incorporated as the frame is assembled. The embodiments shown in FIGS. 7 and 8 are only particular examples of this aspect of the present invention, and should not be construed as limiting its scope. Other embodiments incorporating features such as cup holders, magazine racks, television remote control holders and the like, and locating them in or on various surfaces of the frame, are also contemplated as being within the scope of the present invention.

As an example of the improved packaging efficiency of an upholstered ready-to-assemble article of furniture provided by the present invention vis-a-vis that which has been pre-assembled, an upholstered sofa measuring 85 inches long by 33 inches high by 33 inches deep (53.6 cubic feet) would, if pre-assembled, require a box of at least these dimensions, whereas by the present invention only a frame box 77 inches by 3.5 inches by 26.5 inches (4.1 cubic feet), a reduced volume padding box 34.5 inches by 10 inches by 29.5 inches (5.9 cubic feet) and a coverings box 4.75 inches by 18.5 inches by 22 inches (1.1 cubic feet) would be required.

While this invention has been described as having exemplary methods and designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method for packaging a ready-to-assemble article of seating furniture comprising:

providing an unassembled frame, said frame including a plurality of rigid frame members which are adapted to interconnect to form a frame for said article of seating furniture;

providing at least one padding element said padding element defining a seat support surface for a said article of seating furniture;

reducing the volume of said padding element by one of vacuum packing and compression packing; and packaging said frame members and said at least one reduced volume padding element in at least one container.

2. The method for packaging a ready-to-assemble article of seating furniture of claim 1, further comprising:

providing at least one decorative [covers] cover for said article of seating furniture; and packaging said decorative covers.

3. The method for packaging a ready-to-assemble article of seating furniture of claim 1, wherein said reducing step involves reducing the volume of said at least one padding element by at least approximately two thirds (⅔).

4. The method for packaging a ready-to-assemble article of seating furniture of claim 1, wherein said reducing step involves reducing the volume of said at least one padding element by at least approximately five sixth (⅚).

5. A ready-to-assemble article of seating furniture comprising:

a frame comprising a plurality of unassembled rigid frame members adapted to be assembled and secured together to form a frame;

at least one reduced volume padding element which is one of vacuum packed and compression packed and adapted to fit on said frame and to define a seat support surface for said article of seating furniture when permitted to expand to normal size; and at least one container in which said frame members and said at least one padding element are disposed.

6. The ready-to-assemble article of seating furniture of claim 5, wherein said at least one padding element comprises an enveloping protective cover.

7. The ready-to-assemble article of seating furniture of claim 5, wherein said at least one padding element comprises a bladder and a foam covering therefor.

8. The ready-to-assemble article of seating furniture of claim 7, wherein said at least one padding element comprises an enveloping protective cover.

9. The ready-to-assemble article of seating furniture of claim 7, said bladder comprising baffles.

10. The ready-to-assemble article of seating furniture of claim 5, further comprising:

a decorative cover including fastening means, said decorative cover adapted to be secured by said fastening means over at least one of said padding elements.

11. The ready-to-assemble article of seating furniture of claim 5, further comprising:

a decorative cover including fastening means, said decorative cover adapted to be secured by said fastening means over said frame and at least one of said padding elements.

12. The ready-to-assemble article of seating furniture of claim 5, said frame comprising a bookcase.

13. The ready-to-assemble article of seating furniture of claim 5, said frame comprising a shelf.

14. The ready-to-assemble article of seating furniture of claim 5, said frame comprising at least one drawer.

15. A method of assembling a ready-to-assemble article of seating furniture comprising:

providing a container including therein a plurality of rigid frame members and at least one reduced volume padding element which has been reduced in size by one of vacuum packing and compression packing;

expanding said at least one padding element to define a seat support surface for a said article of seating furniture;

interconnecting said plurality of rigid frame members to form a frame for a said article of seating furniture; and assembling said at least one padding element to said frame to form a completed article of seating furniture.

16. The method of assembling a ready-to-assemble article of seating furniture according to claim 15, wherein said expanding of said at least one padding element includes adding fluid to a bladder associated with said at least one padding element.

17. The method of assembling a ready-to-assemble article of seating furniture according to claim 16, further comprising:

applying decorative covers to said at least one padding element prior to assembling said at least one padding element to said frame.

18. The method of assembling a ready-to-assemble article of seating furniture according to claim 16, further comprising:

applying decorative covers to said at least one padding element after assembling said at least one padding element to said frame.

19. The method of assembling a ready-to-assemble article of seating furniture according to claim 15, further comprising:

applying decorative covers to said at least one padding element prior to assembling said at least one padding element to said frame.

20. The method of assembling a ready-to-assemble article of seating furniture according to claim 15, further comprising:

applying decorative covers to said at least one padding element after assembling said at least one padding element to said frame.

* * * * *